US008684280B2

(12) United States Patent
Cox

(10) Patent No.: US 8,684,280 B2
(45) Date of Patent: Apr. 1, 2014

(54) FASTENING RAILWAY RAILS

(75) Inventor: Stephen John Cox, Richmond (GB)

(73) Assignee: Pandrol Limited, Addlestone, Surrey (GB)

( * ) Notice: Subject to any disclaimer, the term of this patent is extended or adjusted under 35 U.S.C. 154(b) by 196 days.

(21) Appl. No.: 13/263,060

(22) PCT Filed: Mar. 26, 2010

(86) PCT No.: PCT/GB2010/000587
§ 371 (c)(1),
(2), (4) Date: Oct. 27, 2011

(87) PCT Pub. No.: WO2010/116118
PCT Pub. Date: Oct. 14, 2010

(65) Prior Publication Data

US 2012/0160924 A1 Jun. 28, 2012

(30) Foreign Application Priority Data

Apr. 6, 2009 (GB) ..... 0905918.9

(51) Int. Cl.
*E01B 9/00* (2006.01)

(52) U.S. Cl.
USPC ..... 238/315; 238/84; 238/349

(58) Field of Classification Search
USPC ..... 238/264, 265, 310, 215, 318, 319, 328, 238/330, 331, 348, 349, 350, 351
See application file for complete search history.

(56) References Cited

U.S. PATENT DOCUMENTS

| | | | | |
|---|---|---|---|---|
| 4,074,860 | A * | 2/1978 | Rex | 238/349 |
| 4,312,478 | A * | 1/1982 | Matsuo et al. | 238/349 |
| 4,399,941 | A * | 8/1983 | Lubbers | 238/349 |
| 4,770,343 | A * | 9/1988 | Heim et al. | 238/349 |
| 5,782,406 | A * | 7/1998 | Igwemezie | 238/67 |
| 6,305,613 | B1 * | 10/2001 | Igwemezie | 238/287 |
| 6,572,027 | B1 * | 6/2003 | Pilesi et al. | 238/310 |
| 7,703,695 | B2 * | 4/2010 | Young et al. | 238/352 |

(Continued)

FOREIGN PATENT DOCUMENTS

| | | |
|---|---|---|
| CH | 253427 | 3/1948 |
| DE | 100 23 389 A1 | 11/2001 |

(Continued)

OTHER PUBLICATIONS

United Kingdoms's Intellectual Property Office's Search Report corresponding to Application No. GB0905918.9, dated Mar. 11, 2010.

(Continued)

*Primary Examiner* — Jason C Smith
(74) *Attorney, Agent, or Firm* — Paul M. Vargo; Husch Blackwell LLP

(57) ABSTRACT

A concrete railway rail foundation wherein an uppermost face of the foundation comprises a rail seat area for supporting a railway rail extending in a first direction across the rail seat area, two anchoring device seating regions located on either side of the rail seat area for accommodating respective anchoring devices, and, on each side of an anchoring device seating region, an upstanding portion having a height substantially the same as or higher than that of an anchoring device and a depth, in a second direction substantially perpendicular to the first direction, which is substantially the same as or deeper than that of the anchoring device is disclosed.

18 Claims, 4 Drawing Sheets

(56) References Cited

U.S. PATENT DOCUMENTS

| | | | | |
|---|---|---|---|---|
| 8,033,480 | B2 * | 10/2011 | Hohne et al. | 238/315 |
| 2003/0080195 | A1 * | 5/2003 | Mediavilla | 238/315 |
| 2010/0301126 | A1 * | 12/2010 | Meyer | 238/303 |
| 2013/0015256 | A1 * | 1/2013 | Bednarczyk et al. | 238/315 |
| 2013/0153671 | A1 * | 6/2013 | Bosterling et al. | 238/349 |

FOREIGN PATENT DOCUMENTS

| | | | |
|---|---|---|---|
| FR | 2 764 316 | | 12/1998 |
| GB | 2 105 389 | A | 3/1983 |
| GB | 2 117 816 | A | 10/1983 |
| GB | 2 211 230 | A | 6/1989 |
| GB | 2 384 020 | A | 7/2003 |
| JP | 2006-45989 | | 8/2007 |
| WO | WO 96/23107 | | 8/1996 |
| WO | WO 00/22235 | | 4/2000 |
| WO | WO 00/26469 | | 5/2000 |
| WO | WO 02/099195 | A1 | 12/2002 |

OTHER PUBLICATIONS

United Kingdoms's Intellectual Property Office's Search Report corresponding to Application No. GB1005120.9, dated Jul. 22, 2010.

United Kingdoms's Intellectual Property Office's Search Report corresponding to Application No. GB1005120.9, dated Nov. 8, 2010.

PCT International Preliminary Report on Patentability corresponding to International Application No. PCT/GB2010/000587, dated Oct. 11, 2011.

PCT Written Opinion of the International Searching Authority corresponding to International Application No. PCT/GB2010/000587, dated Oct. 6, 2011.

Machine translation of claims and description from the EPO Register for FR2764316.

Machine translation of claims and description from the EPO Register for DE10023389.

Machine translation of the abstract from the EPO Register forJP2006045989 (A).

English translation of the specification for CH253427.

Machine translation of claims and description from the EPO Register for WO0026469.

* cited by examiner

FASTENING RAILWAY RAILS

The present invention relates to fastening railway rails.

GB2384020B discloses a railway rail fastening assembly, as shown in FIG. 1 of the accompanying drawings, for securing a rail 1 to an underlying concrete sleeper 2. The rail fastening assembly comprises railway rail fastening clips 3, which bear on the rail foot, retained by respective anchoring devices 4 secured to the upper surface of the sleeper 2. The rail clip 3 is of a type driven onto the rail laterally. The clip 3 is formed of an elongate plate shaped such that a central region 31 of the plate has in profile the form of a letter C, one end region of the plate extending from one side of the central region 31 of the plate to form a base region 32 for engaging a cavity 40 in the anchoring device 4 and the other end region of the plate on the other side of the central region 31 forming a toe region 33 for bearing on the rail 1. The toe region 33 of the clip is bifurcated so as to have two toe portions 33*a*, 33*b* each carrying a toe insulator 34*a*, 34*b* for electrically insulating the clip 3 from the rail 1. The anchoring device 4 is electrically insulated from the rail 1 by a side post insulator 5 located between a face of the anchoring device 4 and the rail foot. Between the rail 1 and the sleeper 2 there is a cushioning pad 6. The cushioning pad 6 has ears for positioning the pad 6 with respect to the anchoring devices 4.

It is desirable to provide an improved concrete rail foundation and components for use therewith.

According to an embodiment of a first aspect of the present invention there is provided a concrete railway rail foundation on which anchoring devices for retaining railway rail fastening clips are to be located when the foundation is in use, wherein the face of the foundation which is to be uppermost when the foundation is in use has a rail seat area for supporting a railway rail extending in a first direction across the rail seat area, two anchoring device seating regions located on either side of the rail seat area for accommodating respective anchoring devices to be located on the foundation, and, on each side of each anchoring device seating region, an upstanding portion having a height substantially the same as or higher than that of an anchoring device to be located on the foundation and a depth, in a second direction substantially perpendicular to the first direction, which is substantially the same as or deeper than that of the said anchoring device.

Because of the upstanding portions, a rail foundation embodying the first aspect of the present invention has a much wider reaction face for lateral forces, allowing a side post insulator, which is to be located between an anchoring device on the foundation and a rail foot, to be made much wider, which can improve side post insulator performance, for example on tightly-curved track. A second advantage is that the upstanding portions can afford some protection to the anchoring devices in the event of a train derailment. Although if an upstanding portion of the foundation was damaged by a train some of the benefit of the wider bearing would be lost, if the anchoring device was undamaged the foundation would remain serviceable.

Preferably, the upstanding portions extend in substantially the said first direction.

Desirably, upstanding portions are provided on each side of each anchoring device seating region.

Preferably the upstanding portions are configured such that, when an anchoring device is located on the foundation between adjacent ones of the upstanding portions, at least one of the upstanding portions abuts the anchoring device.

Alternatively, the upstanding portions may be configured such that, when an anchoring device is located on the foundation between adjacent ones of the upstanding portions, there is a gap extending in the said first direction between the anchoring device and at least one of the upstanding portions.

Desirably, each upstanding portion has a substantially curved upper surface. The height of each upstanding portion may reduce gradually in the said second direction proceeding from the upper surface thereof towards a rear end of the upstanding portion. Each upstanding portion may have a depth which is longer than that of the anchoring device to be located on the foundation, providing the upstanding portions do not then provide an obstacle to rail clip installation or extraction or to equipment for installing or extracting a rail clip into or from the anchoring device, in which case part of the rear end of each upstanding portion which extends beyond a rear end of the anchoring device may have a first section which is substantially concave and then a more steeply curved substantially convex second section.

If the foundation is a railway sleeper, each upstanding portion may extend away from the anchoring device seating region in substantially the first direction up to the edge of the sleeper.

According to an embodiment of a second aspect of the present invention there is provided a concrete railway rail foundation assembly comprising a concrete railway rail foundation as claimed in any preceding claim and an anchoring device located in one of the said anchoring device seating regions on the uppermost face of the foundation, the anchoring device comprising an anchoring device body having a front face, the body extending above the uppermost face of the foundation such that the front face of the body is adjacent to a railway rail when the assembly is in use, wherein the front face is provided with end parts which extend outwardly from the body, such that each end part overlaps part of an adjacent one of the said upstanding portions.

According to an embodiment of a third aspect of the present invention there is provided an electrical insulator for location between a foot of a railway rail and an adjacent anchoring device, for use with a foundation embodying the first aspect of the present invention, wherein the insulator has a reaction face which is wider than the face of the anchoring device against which it is to abut. Preferably, in order to provide abutment faces whereby the insulator is made more resistant to longitudinal movement, the reaction face of the insulator is thinner at a centre portion thereof which is to abut the face of the anchoring device than at end portions thereof.

Reference will now be made, by way of example, to the accompanying drawings, in which:

FIG. 2A showing an exploded perspective view and FIG. 2B showing a smaller perspective view;

Figure 1:
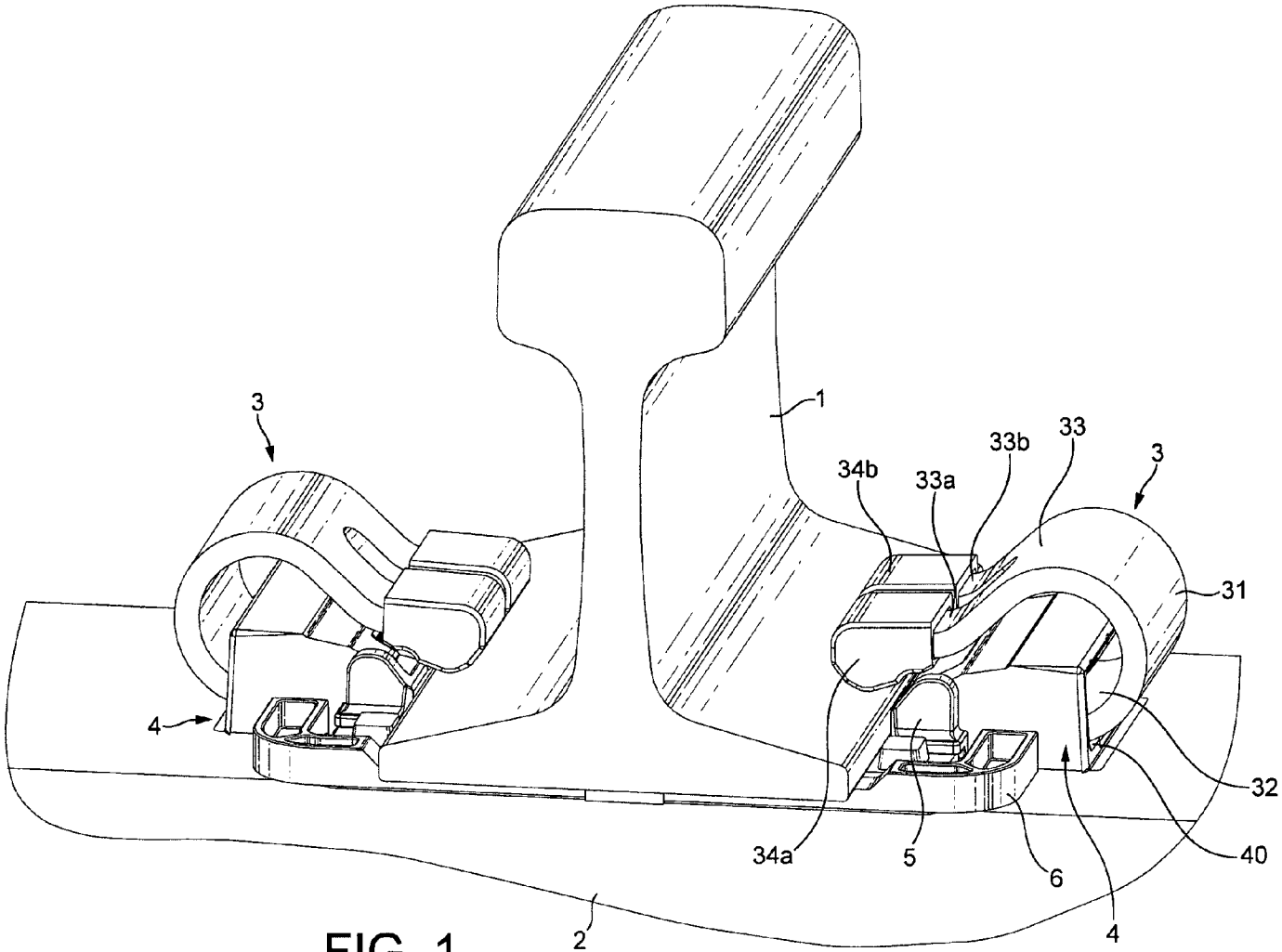
FIG. 1 (described above) shows a prior art railway rail fastening assembly.
Figure 2:
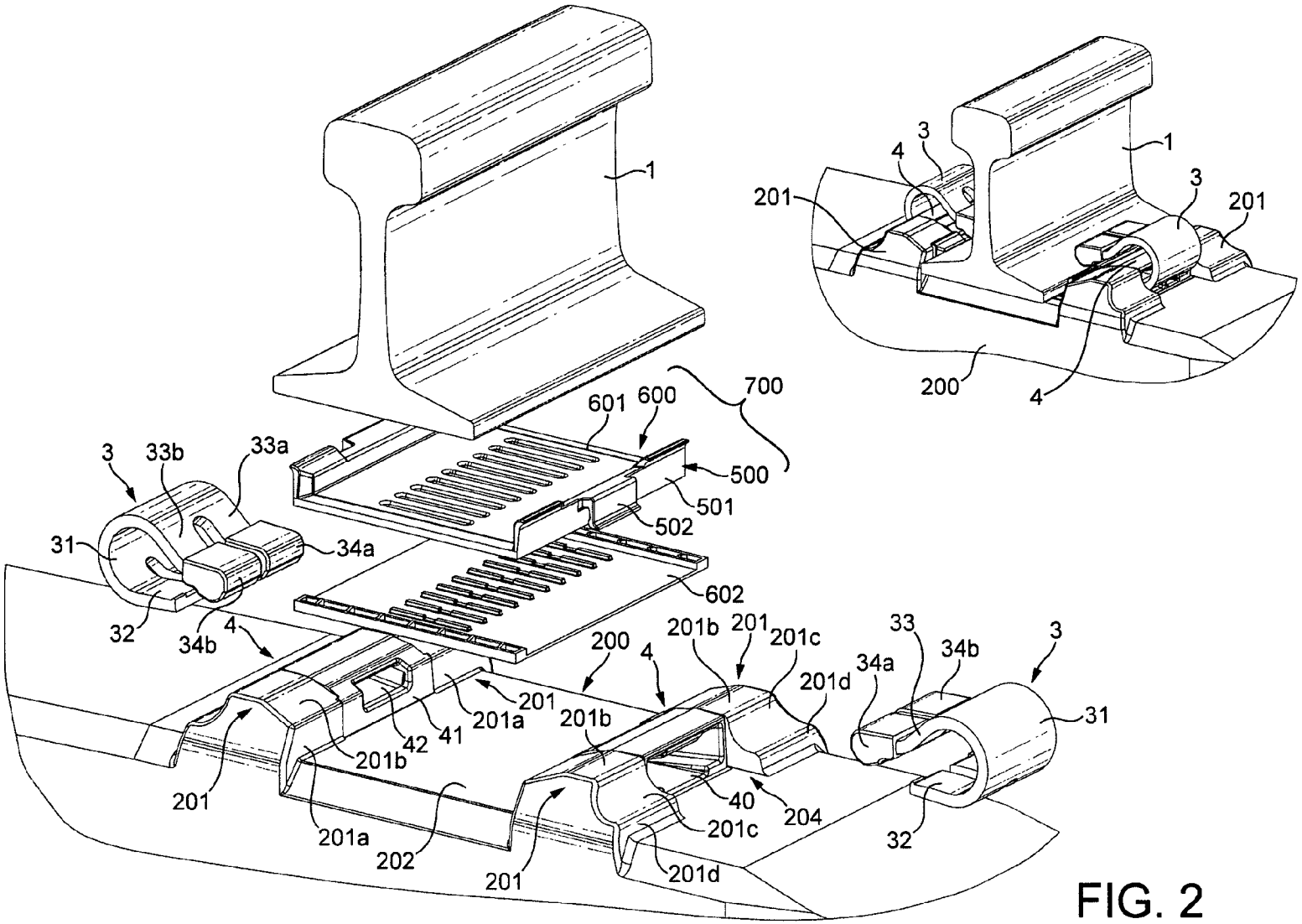
FIG. 2 shows a first concrete rail foundation embodying the present invention, together with a rail and components of a rail fastening assembly.

A first concrete rail foundation embodying the first aspect of the present invention, consisting of a concrete sleeper 200, is shown in FIG. 2, together with a railway rail 1 and a rail fastening assembly comprising rail clips 3 and anchoring devices 4 of the types described with reference to FIG. 1. The sleeper 200 has on its face which is uppermost when the sleeper is in use a rail seat area 202 on which the rail 1 sits so as to extend in a first direction when the sleeper is in use. On each side of the rail seat area 202 the sleeper 200 is provided on its uppermost face with two upstanding portions (hereafter referred to as "upstands") 201 which are spaced apart from one another, and extend, in substantially the first direction (the width direction of the sleeper) so as to define an opening 204 between them in which an anchoring device seating region for receiving one of the anchoring devices 4 is located. In this embodiment of the sleeper 200, the size of the opening 204 in the first direction is substantially the same as the width of the anchoring device 4 to be located in the anchoring device seating region, and the depth of the upstand 201 in a second direction, substantially perpendicular to the first direction, is greater than that of the anchoring device 4. In this embodiment, the maximum height of each upstand 201 is substantially the same as the maximum height of the anchoring device 4, but in other embodiments it may be higher but no lower.

Each upstand 201 has a front face 201*a* adjacent to the rail seat area 202 of the sleeper 200 which is a substantially upright planar surface. In this embodiment, when the anchoring device 4 is located in the opening 204, a front face 41 of the anchoring device 4 is substantially in line with the front faces 201*a* of the upstands 201 on either side of the anchoring device 4. Each upstand 201 has a substantially curved upper surface 201*b*, defining the height of the upstand 201, which extends in the second direction to approximately the same depth as the anchoring device 4. Each upstand 201 in this embodiment is shaped so that the height of the upstand 201 reduces gradually from the upper surface 201*b* towards the rear of the upstand 201, this part of the upstand 201 having a first, substantially concave, section 201*c* and then a second, more steeply curved, substantially convex section 201*d*. The upstands 201 are shaped to try to deflect a derailed wheel upwards and over the anchoring device 4.

In this embodiment, the rail fastening assembly for use with the sleeper 200 also comprises a sidepost insulator 500 having a wide reaction face 501 for receiving lateral forces from the rail 1 when located between the foot of the rail 1 and one of the anchoring devices 4 on the sleeper 200. In this embodiment the reaction face 501 of the side post insulator 500 has substantially the same width as that of the anchoring device 4 and the two adjacent upstands 201 together, extending across substantially the whole width of the sleeper 200 in the first direction, so that the lateral forces from the rail are transmitted through the reaction face 501 of the insulator 500 to the front face 41 of the anchoring device 4 and the front faces 201*a* of the upstands 201. Alternatively (not shown) the reaction face of the insulator could be wider than the front face of the insulator but not extend over the whole length of the front faces of the upstands. The insulator 500 has a tab 502 for engaging a corresponding slot in the anchoring device 4, to assist in correctly locating the side post insulator 500. In this embodiment the side post insulator 500 is combined with a cushioning pad 600 to form a combined side post insulator/pad 700, but this need not be the case. Unlike the pad 6 of FIG. 1, the cushioning pad 600 does not have ears, but is designed to locate and be retained in the rail seat portion 202 of the sleeper 200. Engagement of the tab 502 of the sidepost insulator 500 with which the pad 600 is combined provides the pad with further resistance to longitudinal movement. In this example, the pad 600 has a two layer structure, having an upper layer 601 attached to the insulator 500 and a lower layer 602.

Figure 3:
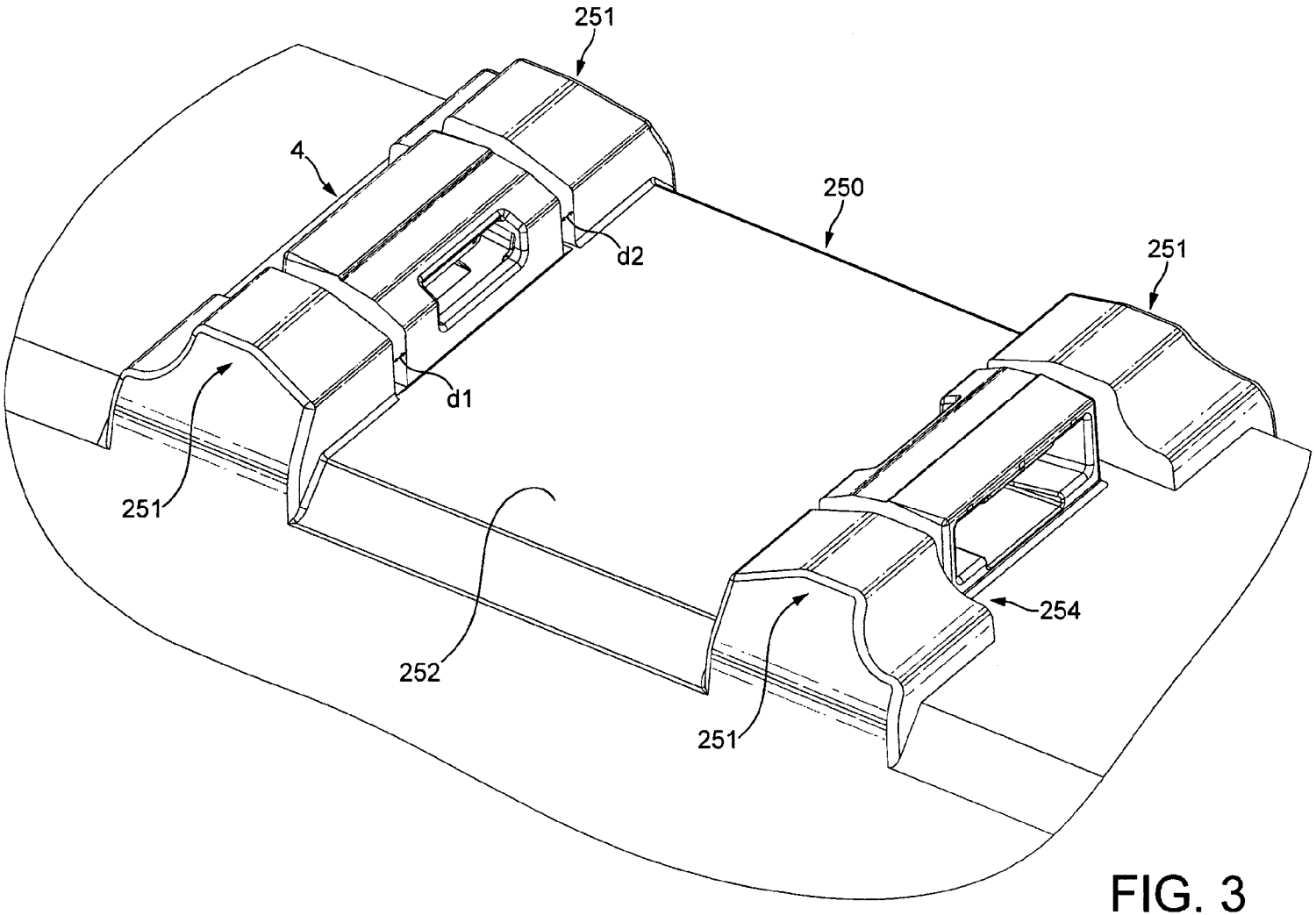
FIG. 3 shows a second concrete rail foundation embodying the present invention and a component of a rail fastening assembly.

In the sleeper shown in FIG. 2, the upstands 201 abut right up to the anchoring device 4 and act as a buffer to prevent damage from a derailed wheel should derailment occur, but alternatively the upstands can be set back slightly from the anchoring device with a small air-gap so that, if a wheel hits an upstand, no longitudinal impact force will be transmitted directly from the upstand into the anchoring device. Such an arrangement is shown in FIG. 3 in which a concrete rail foundation consisting of a sleeper 250 has upstands 251 which are separated by a greater distance so that they define an opening 254 having a width somewhat larger than that of the anchoring device 4, which leaves gaps between the anchoring device 4 and the upstands 251 on either side of it having respective widths $d_1$ and $d_2$. The upstands 251 are otherwise the same as the upstands 201. In the example shown in FIG. 3, $d_1=d_2$. For example, the width $d_1/d_2$ may be 7.5 mm.

Figure 4:
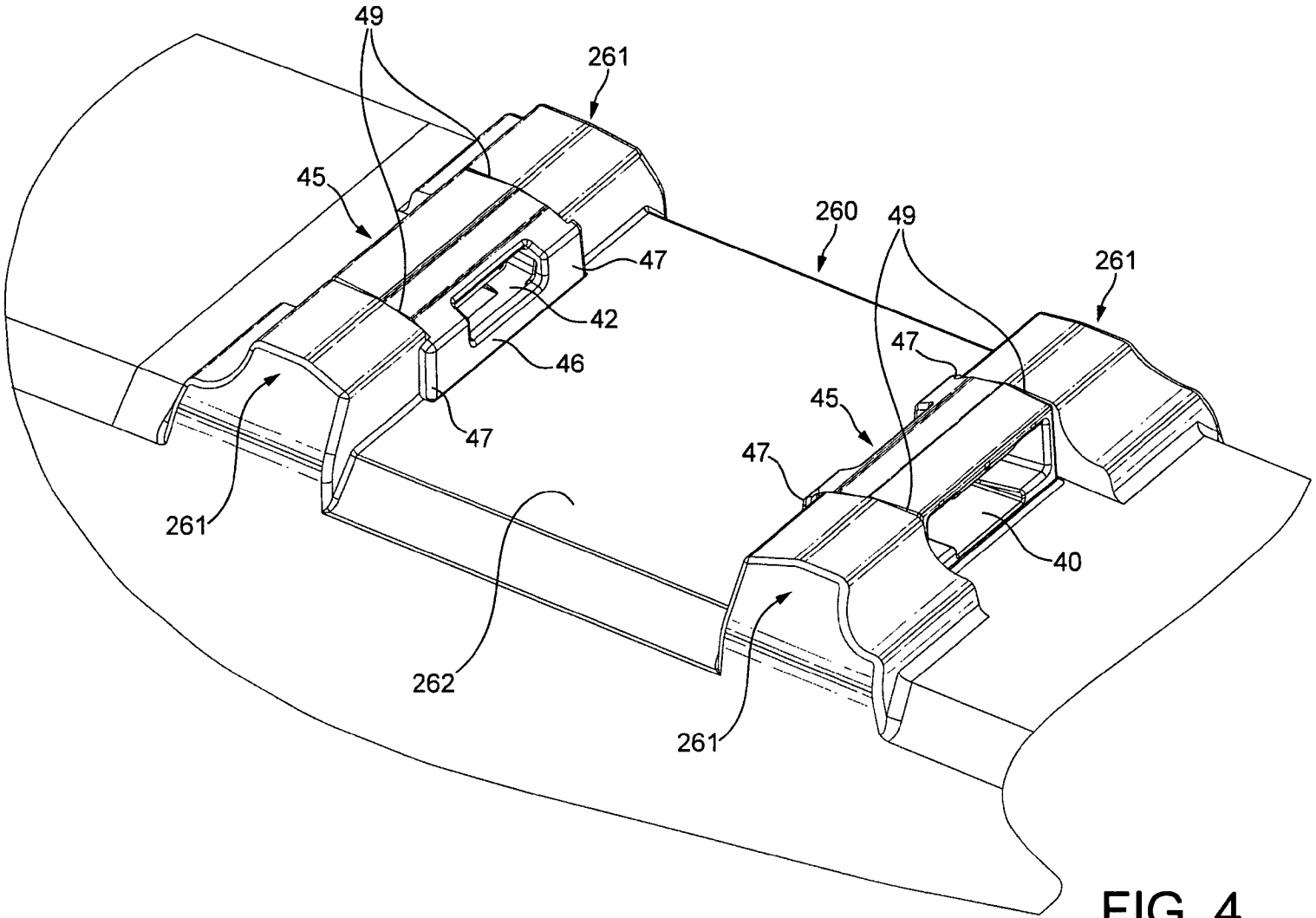
FIG. 4 shows a third concrete rail foundation embodying the present invention and a component of a rail fastening assembly.

An alternative arrangement is shown in FIG. 4 in which a concrete rail foundation consisting of a sleeper 260 has upstands 261 which are set back slightly as compared to the front face 46 of an anchoring device 45, so that the distance between the upstands 261 across the rail seat area 262 of the sleeper 260 is greater than in the embodiments shown in FIGS. 2 and 3. Since the position of the rear of the upstands in general is limited by the need not to foul track equipment, the upstands 261 are slightly reduced in depth compared to the upstands 201, 251, so that the rear of these upstands 261 does not end any further back than the rear of the upstands 201, 251. Otherwise, the upstands 261 are the same as the upstands 201 of FIG. 2. The front face 46 of the anchoring device 45 is wider than the width of the body 48 of the anchoring device 45 between the upstands 261, having a part 47 at each end of the front face 46 which extends outwardly from the sides 49 of the body. In this embodiment, the parts 47 overlap the upstands 261 for a short distance. The reaction face of a side post insulator (not shown) for use with such an anchoring device 45 would be shaped so as to be correspondingly thinner at its centre portion, the thicker portions of the reaction face on either side of the thinner centre portion serving to provide faces against which the parts 47 of the anchoring device 45 abut, whereby the side post insulator, and the pad with which it is combined, will be more resistant to longitudinal movement. This is particularly advantageous where the anchoring device is not provided with any kind of slot in its front face for engaging part of the side post insulator.

Although the foundation of FIGS. 2 to 4 has been described with reference to an anchoring device which is the same as or similar to that shown in FIG. 1, a concrete rail foundation embodying the first aspect of the present invention can be used with different kinds of anchoring devices. More particularly, a sleeper embodying the first aspect of the present invention can be used with any rail fastening assembly in which the clip is applied perpendicularly to the rail.

A rail foundation embodying the first aspect of the present invention could be made using moulds, which could be a modification of those used to make the sleepers 2, which are shaped so that a concrete upstand 201/251/261 is created on either side of the anchoring device seating region.

The invention claimed is:

1. A concrete railway rail foundation on which anchoring devices for retaining railway rail fastening clips are to be located when the foundation is in use, comprising a rail seat area for supporting a railway rail, two anchoring device seating regions located on either side of the rail seat area for accommodating respective anchoring devices, and, on each side of an anchoring device seating region, an upstanding portion integral with the foundation and having a height substantially the same as or higher than that of an anchoring device to be located on the foundation and a depth, which is substantially the same as or deeper than that of the anchoring device.

2. A foundation as in claim 1, wherein upstanding portions are provided on each side of each anchoring device seating region.

3. A foundation as in claim 1, wherein the upstanding portions are configured such that, when an anchoring device is located on the foundation between adjacent ones of the upstanding portions, at least one of the upstanding portions abuts the anchoring device.

4. A foundation as in claim 1, wherein the upstanding portions are configured such that, when an anchoring device is located on the foundation between adjacent ones of the upstanding portions, there is a gap between the anchoring device and at least one of the upstanding portions.

5. A foundation as in claim 1, wherein each upstanding portion has a substantially curved upper surface.

6. A foundation as in claim 5, wherein the height of each upstanding portion slopes downward proceeding from the upper surface thereof towards a rear end of the upstanding portion.

7. A foundation as in claim 6, wherein each upstanding portion has a depth which is greater than that of the anchoring device to be located on the foundation and part of the rear end of each upstanding portion which extends beyond a rear end of the anchoring device has a first section which is substantially concave and a substantially convex second section.

8. A foundation as in claim 1, wherein the foundation is a railway sleeper and each upstanding portion extends away from the anchoring device seating region up to the edge of the sleeper.

9. A concrete railway rail foundation assembly comprising a concrete railway rail foundation as in claim 1 and an anchoring device located in one of the anchoring device seating regions wherein the anchoring device comprises an anchoring device body having a front face, the body extending above the foundation such that the front face of the body is adjacent to a railway rail when the assembly is in use, wherein the front face is provided with end parts which extend outwardly from the body, such that each end part overlaps part of an adjacent one of the upstanding portions.

10. An electrical insulator for location between a foot of a railway rail and an adjacent anchoring device, for use with the assembly of claim 9, wherein the insulator has a reaction face which is wider than the face of the anchoring device against which it is to abut.

11. An insulator as in claim 10, wherein the reaction face of the insulator is thinner at a center portion thereof which is to abut the face of the anchoring device than at end portions thereof.

12. An electrical insulator for location between a foot of a railway rail and an adjacent anchoring device, for use with the foundation of claim 1, wherein the insulator has a reaction face which is wider than the face of the anchoring device against which it is to abut.

13. An insulator as in claim 12, wherein the reaction face of the insulator is thinner at a center portion thereof which is to abut the face of the anchoring device than at end portions thereof.

14. A concrete railway rail foundation on which anchoring devices for retaining railway rail fastening clips are to be located comprising a rail seat area for supporting a railway rail, two anchoring device seating regions located on either side of the rail seat area for accommodating respective anchoring devices, and, on each side of an anchoring device seating region, an upstanding portion having a height substantially the same as or greater than that of a respective anchoring device and a depth, which is substantially the same as or deeper than that of the respective anchoring device.

15. A foundation as in claim 14, wherein upstanding portions are provided on each side of each anchoring device seating region.

16. A foundation as in claim 14, wherein the upstanding portions are configured such that, when an anchoring device is located on the foundation between adjacent ones of the upstanding portions, at least one of the upstanding portions abuts the anchoring device.

17. A foundation as in claim 14, wherein the upstanding portions are configured such that, when an anchoring device is located on the foundation between adjacent ones of the upstanding portions, there is a gap between the anchoring device and at least one of the upstanding portions.

18. A foundation as in claim 14, wherein each upstanding portion has a substantially curved upper surface, and wherein the height parameter of each upstanding portion decreases from an upper surface thereof towards a rear end of the upstanding portion.

* * * * *